US011021960B2

(12) United States Patent
Spadacini et al.

(10) Patent No.: US 11,021,960 B2
(45) Date of Patent: Jun. 1, 2021

(54) SET OF TURBINES AND A TURBINE TRAIN COMPRISING AT LEAST ONE SUCH SET

(71) Applicant: EXERGY S.P.A., Bologna (IT)

(72) Inventors: Claudio Spadacini, Verbania Suna (IT); Dario Rizzi, Bisuschio (IT)

(73) Assignee: EXERGY INTERNATIONAL S.R.L., Olgiate Olona (IT)

( * ) Notice: Subject to any disclaimer, the term of this patent is extended or adjusted under 35 U.S.C. 154(b) by 154 days.

(21) Appl. No.: 16/315,993

(22) PCT Filed: Jun. 29, 2017

(86) PCT No.: PCT/IB2017/053900
§ 371 (c)(1),
(2) Date: Jan. 7, 2019

(87) PCT Pub. No.: WO2018/007909
PCT Pub. Date: Jan. 11, 2018

(65) Prior Publication Data

US 2019/0257203 A1 Aug. 22, 2019

(30) Foreign Application Priority Data

Jul. 5, 2016 (IT) ..... 102016000069753

(51) Int. Cl.
*F01D 5/06* (2006.01)
*F01D 5/02* (2006.01)
*F01D 5/04* (2006.01)

(52) U.S. Cl.
CPC ..... *F01D 5/066* (2013.01); *F01D 5/026* (2013.01); *F01D 5/041* (2013.01); (Continued)

(58) Field of Classification Search
CPC . F01D 5/041; F01D 1/023; F01D 3/02; F01D 3/025
See application file for complete search history.

(56) References Cited

U.S. PATENT DOCUMENTS 876,628 A * 1/1908 Fulmer ..... F01D 3/02 415/103
2,174,806 A 10/1939 Soderberg
(Continued)

FOREIGN PATENT DOCUMENTS

BE 351 240 A 5/1928
DE 11 62 134 B 1/1964
(Continued)

OTHER PUBLICATIONS

Oct. 5, 2017 International Search Report issued in International Patent Application No. PCT/IB2017/053900.
(Continued)

*Primary Examiner* — Juan G Flores
(74) *Attorney, Agent, or Firm* — Oliff PLC

(57) ABSTRACT

A set of turbines, including: a first turbine including a first shaft supported in an overhung manner in a first case, a first rotor provided with first rotor blades and joined to a distal end of the first shaft; a second turbine including a second shaft supported in an overhung manner in a second case, and a second rotor provided with second rotor blades and joined to a distal end of the second shaft. A first front face of the first rotor faces a second front face of the second rotor. The set of turbines further includes a connection element connected to the first front face and to the second front face to transmit rotation from the first shaft to the second shaft or vice versa. The connection element includes at least one elastic joint configured to minimize the rotordynamic influence of the first and second turbine on each other.

15 Claims, 9 Drawing Sheets

(52) U.S. Cl.
CPC ..... *F05D 2220/32* (2013.01); *F05D 2230/60* (2013.01); *F05D 2260/30* (2013.01)

(56) References Cited

U.S. PATENT DOCUMENTS

| | | | | |
|---|---|---|---|---|
| 5,042,247 | A | 8/1991 | Moore | |
| 5,737,912 | A | 4/1998 | Krakowitzer | |
| 5,780,932 | A | 7/1998 | Laffont | |
| 2012/0177494 | A1 | 7/2012 | Parashar et al. | |
| 2014/0093357 | A1* | 4/2014 | Polacco | F01D 5/066 415/122.1 |

FOREIGN PATENT DOCUMENTS

| | | | | | |
|---|---|---|---|---|---|
| EP | 0 52 660 | A1 | | 6/1982 | |
| EP | 2 479 377 | A2 | | 7/2012 | |
| EP | 2 687 678 | A1 | | 1/2014 | |
| FR | 928577 | A | | 12/1947 | |
| GB | 492081 | A | | 9/1938 | |
| GB | 687 104 | A | | 2/1953 | |
| GB | 929323 | A | * | 6/1963 | F01D 5/026 |
| GB | 929323 | A | | 6/1963 | |
| GB | 1 201 767 | A | | 8/1970 | |
| WO | 97/12126 | A2 | | 4/1997 | |
| WO | 2012/156520 | A1 | | 11/2012 | |
| WO | 2013/007463 | A1 | | 1/2013 | |

OTHER PUBLICATIONS

Oct. 5, 2017 Written Opinion of the International Searching Authority issued in International Patent Application No. PCT/IB2017/053900.

* cited by examiner

SET OF TURBINES AND A TURBINE TRAIN COMPRISING AT LEAST ONE SUCH SET

FIELD OF THE INVENTION

The object of the present invention is a set of turbines and a turbine train comprising at least one such set.

The present invention falls within the scope of power plants for generating electrical energy and is intended for expansion systems configured to convert the energy of an expanding working fluid into mechanical energy, making one or more turbine rotors rotate, and then into electrical energy.

The present invention particularly refers to systems constituted by a plurality of turbines that are mechanically connected in series with their shafts aligned (turbine train).

BACKGROUND OF THE INVENTION

There are several known public documents that illustrate solutions with two or more turbines, the shafts of which are connected to each other so as to realize an array of aligned turbines.

For example, document WO2013/007463 illustrates a power generation system provided with a train of turbines with the rotors thereof set in serial arrangement and operatively coupled to each other and to a generator.

Document U.S. Pat. No. 2,174,806 illustrates a pair of turbines (a high-pressure turbine and a low-pressure turbine). The rotors of the turbines are aligned and connected by a coupling.

Document FR928577 illustrates two steam turbines that are coupled by means of a flexible shaft.

Document U.S. Pat. No. 5,780,932 illustrates an electricity generating unit comprising a gas turbine, a steam turbine having a plurality of modules, and an electricity generator, the above being mounted in succession along a common axis with the respective shafts being connected by rigid couplings.

Document GB492081 illustrates a power system comprising a high-pressure gas turbine and a low-pressure gas turbine connected in series by means of a coupling that rigidly connects the respective shafts.

Document EP0852660 illustrates a system with a first gas turbine, a generator, a low-pressure steam turbine, a high-pressure steam turbine and a second gas turbine, in a sequence.

Document U.S. Pat. No. 5,737,912 illustrates a power station comprising a gas turbine group and a steam turbine coupled by means of a coupling to the gas turbine group.

Document U.S. Pat. No. 5,042,247 illustrates a system comprising a steam turbine made up of two sections that are joined to each other by a rigid coupling.

Document GB929323 illustrates a flexible coupling for rotating parts, particularly for rotary shafts of turbine-generator sets.

Also known is patent US2012/177494 (also published as EP2479377), which illustrates the rotor of a steam turbine having a high-temperature section with a respective rotor wheel and a low-temperature section with a respective rotor wheel, both being made of different materials. The two rotor wheels are directly interconnected to each other by means of a coupling that prevents relative rotation of the two sections, such as: a circumferential array of axially-extending bolts or a reduced diameter portion housed in a blind bore and bolts oriented radially or a threaded stud screwed into a threaded, blind bore or a grooved stud housed in a grooved seat.

Lastly, document WO2012/156520 illustrates a system comprising a gas turbine having a shaft and auxiliary equipment, such as a compressor, an oil pump and mechanical or electrical accessories. The auxiliary equipment is provided with an overhung shaft configured to be connected to the turbine shaft. A flexible joint is located between the overhung shaft and the turbine shaft.

SUMMARY

In this field, the Applicant has observed that several aspects of the solutions of the prior art relating to turbine trains can be improved.

In particular, the Applicant has observed that the turbine trains of the prior art are complex and costly, for the individual turbines making up the train must, in any case, be designed "ad hoc" in order to make it possible to interconnect the shafts. Each individual turbine must be devised for extraction of the rotor shaft from the respective case so as to enable connection of both ends of the shaft to the adjacent turbines or to a turbine and to a generator. It is therefore also necessary to arrange two seals on the shaft to prevent leakage of the working fluid.

Moreover, the rigid connection of the turbines of the prior art implies that the turbines to be combined must be designed together, taking into account the characteristics of both so as to prevent the rotordynamics of one from negatively influencing the other. This involves a great number of hours of engineering to design a set for each new application.

The Applicant has thus perceived the need to propose a new set of two turbines.

In particular, the Applicant has noted that there is a need to:

- obtain a simple solution for connecting two turbines in series so as to realize a simple, reliable and relatively low-cost set;
- obtain a set of turbines that makes it possible to realize turbine trains made up of one or more of such sets, possibly also to be combined with other prior-art turbines.

The Applicant has found that the objectives listed above and others as well can be achieved by a set of turbines comprising two turbines of the overhung type and connected on the free side of the respective rotors by means of an elastic joint.

More specifically, according to an independent aspect, the present invention concerns a set of turbines, which comprises:

a first turbine comprising: a first case, a first shaft supported in the first case, first support elements radially interposed between the first shaft and the first case and configured to enable free rotation of said first shaft with respect to the first case about a first main axis, and a first rotor provided with first rotor blades and joined to a distal end of the first shaft, wherein said first rotor is supported in an overhung manner with respect to the support elements, wherein said first rotor has a first front face facing the opposite side with respect to the first support elements; a second turbine comprising: a second case, a second shaft supported in the second case, second support elements radially interposed between the second shaft and the second case and configured to enable free rotation of said second shaft with respect to the second case about a second main axis, and a second rotor provided with second rotor blades and joined to a distal end of the second shaft, wherein said second rotor is supported in an overhung manner with respect to the second support elements, wherein said second rotor has a second front face facing the opposite side with respect to the second support elements.

The first front face faces the second front face and the first main axis is substantially aligned with the second main axis.

The set of turbines further comprises a connection element connected to the first front face and to the second front face to transmit rotation from the first shaft to the second shaft or vice versa.

Said connection element comprises at least one elastic joint configured to minimize the rotordynamic influence of the first turbine and the second turbine on each other.

The first and/or the second rotor comprise(s) a rotor disc bearing the respective rotor blades on the front face and/or on a respective, radially peripheral portion.

Each one of the two turbines is an "overhung" turbine. The term "overhung turbine" is used to indicate that the rotor or rotor disc is located axially to the side of all the support elements, such as bearings, of the respective shaft. In other words, the rotor or rotor disc of each turbine has a rear face, opposite the front face, from which the respective shaft extends and said rear face faces the elements supporting the shaft in the respective case. The overhung turbine does not have other support elements located in front of the front face.

The elastic, or flexible, joint is a device used to connect two shafts/rotors together with the aim of transmitting torque even when the two shafts are slightly misaligned. The elastic, or flexible, joint also enables damping of torsional vibrations. The connection element rotates together with the first and the second rotor and it is capable of absorbing possible misalignments of the respective main axes.

The terms "slightly misaligned" or "substantially aligned" indicate that the axes are inclined by a few degrees with respect to each other (e.g. by about 0.2° to about) 3° and/or that said axes are radially offset with an offset of a few millimetres (e.g. by about 2 mm to about 10 mm).

In the present description and in the appended claims, the adjective "axial" is used to define a direction directed parallel to an axis of rotation of the turbine. The adjective "radial" is used to define a direction directed in the same manner as the radii extending perpendicularly from the axis of rotation. The adjective "circumferential" is understood as referring to directions tangent to circumferences coaxial with the axis of rotation.

The Applicant has verified that the invention makes it possible to connect the two turbines very easily and thus create a relatively simple, reliable and low-cost module.

The Applicant has verified that the elastic joint connecting the two turbines makes it possible to decouple the rotordynamics of the individual turbines, which will thus have little impact on each other.

The Applicant has verified that as the two overhung turbines are connected at the front faces of the respective rotor discs, that is, at the free side of the rotor, it is possible to arrange a single seal on each shaft to isolate the process from the external environment.

The Applicant has also verified that the overhung structure of the two turbines, which face each other, also makes it possible to make use of the space between the two rotor discs to house other elements of the set (such as the conduits for the working fluid which connect the two turbines) so as to make the set very compact and easily installable.

The Applicant has also verified that the set according to the invention makes it possible to configure the turbine train very easily based on the requirements of the specific project, combining a number of sets and/or adding other turbines even of a known type (radial, axial, radial/axial overhung or not overhung) to said one or more sets.

Moreover, the Applicant has also verified that the set/module of the present invention is suited to a connection in series of a number of turbines on a single generator.

In a second aspect, the present invention also concerns a turbine train comprising at least one set of turbines in accordance with the first aspect and/or with the following aspects.

In one aspect, said at least one elastic joint is elastic in flexure. Preferably, said flexure is such as to permit an inclination of the rigid parts which said joint connects of at least 0.2°, preferably of up to about 3°.

In one aspect, said at least one elastic joint is elastic in traction/compression. Preferably, this traction/compression is such as to enable the rigid parts, which said joint connects, to move about +/−5 mm away from/towards each other.

In one aspect, said connection element enables relative movements of the first and the second rotor and said movements consist of the following for example: translational movement along three axes that are perpendicular to each other and/or rotation about a plurality of axes differing from the first and the second main axis.

In one aspect, the rotation about the first and/or the second main axis (torsion) is prevented so as to enable proper transmission of the torque.

In one aspect, said at least one elastic joint is of the type having flexible discs (or lamellae).

In one aspect, the connection element is located at the first and second main axis.

In one aspect, the connection element is connected to the respective centres of the first rotor and the second rotor.

In one aspect, the connection element comprises at least one drive shaft. In one aspect, said at least one drive shaft is substantially aligned with the first shaft and with the second shaft.

In one aspect, the connection element comprises two elastic joints, each one being located at one end of the drive shaft. The elastic joints are located at the opposite ends of the drive shaft and at the centres of the first rotor and the second rotor.

In one aspect, the set comprises a casing connected to the first case and to the second case.

In one aspect, the connection element in contained in said casing.

In other words, with the first and the second case, the casing forms a single, sealed container that contains the rotors, the shafts and also the connection element. The casing also contains the working fluid that passes through the first rotor and/or the second rotor. Preferably, the connection element is immersed in the working fluid.

In one aspect, the casing delimits at least one conduit for a working fluid passing through the first turbine and/or the second turbine.

The function of the casing is not only that of protecting the connection element, but also that of delimiting conduits for the working fluid. This also makes it possible to arrange just one seal for each one of the two shafts between the working fluid and the external environment. Moreover, no seals are needed on the connection element because as specified above, the connection element can be immersed in the working fluid passing through/remaining in the above-mentioned casing.

In one aspect, said at least one conduit sets the first rotor and the second rotor in fluid communication with each other. Carried out in this manner, the realization of the conduits for communication between the turbines makes it possible to utilize the available space and to make the set compact.

In one aspect, the first and the second turbine are connected in parallel as concerns the flow of the working fluid.

In one aspect, the first and the second turbine are connected in series as concerns the flow of the working fluid.

In other words, from the process/energetic point of view, the expansion of the two turbines can be in parallel or in series. An in-parallel connection makes it possible to "dispose of" more mass flow and eliminate the volume flow rate limit at discharge. The in-series connection makes it possible to increase the specific enthalpy and thus also to achieve high volumetric ratios between the inlet and outlet. Furthermore, an in-series connection allows for a second intermediate inlet for a second lower-pressure supply (admission) of the main inlet or steam extraction (tapping).

In one aspect, said at least one conduit is an inlet conduit for admitting the working fluid into the first and/or second turbine. In one aspect, said at least one conduit is an outlet conduit for letting the working fluid flow out from the first and/or second turbine.

In one aspect, said at least one conduit is an inlet conduit for admitting the working fluid into the first rotor and the second rotor. In one aspect, said at least one conduit is an inlet conduit for admitting the working fluid into the first rotor and an outlet conduit for letting it flow out from the second rotor or vice versa.

In one aspect, the casing has an inlet mouth for admitting the working fluid into the set of turbines. In one aspect, the casing has an intermediate mouth for admitting the working fluid into the set of turbines. In one aspect, the casing has an outlet mouth for letting the working fluid flow out from the set of turbines. In one aspect, the casing has an intermediate mouth for tapping the working fluid from the set of turbines.

In one aspect, the casing comprises at least one tubular or substantially tubular body extending between the first case and the second case and it is substantially coaxial with the connection element.

In one aspect, the casing comprises a single tubular or substantially tubular body extending between the first case and the second case and it is substantially coaxial with the connection element.

In one aspect, said at least one conduit is delimited between the single tubular or substantially tubular body and the connection element.

In one aspect, the casing comprises a radially internal tubular body and a radially external tubular body.

In one aspect, said at least one conduit is delimited between the radially internal tubular body and the radially external tubular body.

In one aspect, the radially internal tubular body surrounds the connection element.

In one aspect, the casing incorporates or bears a plurality of first stator blades of the first turbine and/or a plurality of second stator blades of the second turbine.

In one aspect, the first turbine and/or the second turbine comprise(s) a sleeve housed or that can be housed in a seat in the respective case and containing the respective support elements and the respective shaft. In one aspect, said sleeve is extractable from the respective seat on the opposite side with respect to the respective rotor and together with the support elements and the respective shaft.

In one aspect, a proximal end of the first and/or the second shaft and opposite the distal end protrudes from the respective first/second case.

In one aspect, the proximal end comprises connection devices configured to enable joining preferably to another set of turbines or to another turbine or to a generator.

In one aspect, the first turbine and/or the second turbine are of the type selected from the group comprising: radial turbines (centrifugal and centripetal), axial turbines, and radial/axial turbines.

In one aspect, the first rotor and/or the second rotor are of the radial type and comprise(s) a plurality of first/second rotor blades arranged on the respective first/second front face according to at least one annular array concentric with the respective first/second main axis. In one aspect, the first/second rotor blades are arranged according to a number of concentric annular arrays on the respective first/second front face. Said first/second rotor blades extend axially from the respective front face.

In one aspect, the first rotor and/or the second rotor are of the axial type and comprise(s) a plurality of first/second rotor blades arranged on a radially peripheral portion of the respective rotor according to at least one circumferential array. In one aspect, the first/second rotor blades are arranged according to a number of circumferential arrays that are axially spaced on the radially peripheral portion of the respective rotor. Said first/second rotor blades extend radially from the respective radially peripheral portion.

In one aspect, the first rotor and/or the second rotor are of the radial/axial type and comprise(s) a plurality of first/second radial rotor blades arranged on the respective first/second front face according to at least one annular array concentric with the respective first/second main axis, and a plurality of first/second axial rotor blades arranged on a radially peripheral portion of the respective rotor according to at least one circumferential array.

In one aspect, the turbine train comprises at least two sets.

In one aspect, said two sets are connected one to the other at the proximal ends of the respective first or second shaft. In one aspect, a generator is interposed between the two sets. In one aspect, at least one preferably elastic joint is interposed between the two sets.

The present invention also concerns a power plant for generating electrical energy, for example a power station comprising at least one set according to the present invention and/or a turbine train according to the present invention.

Further characteristics and advantages will become more apparent from the detailed description of preferred, but not exclusive, embodiments of a set of turbines according to the present invention.

DESCRIPTION OF THE DRAWINGS

This description is provided herein below with reference to the attached drawings, which are provided solely for purpose of providing approximate and thus non-limiting examples, and of which.

DETAILED DESCRIPTION

Figure 1:
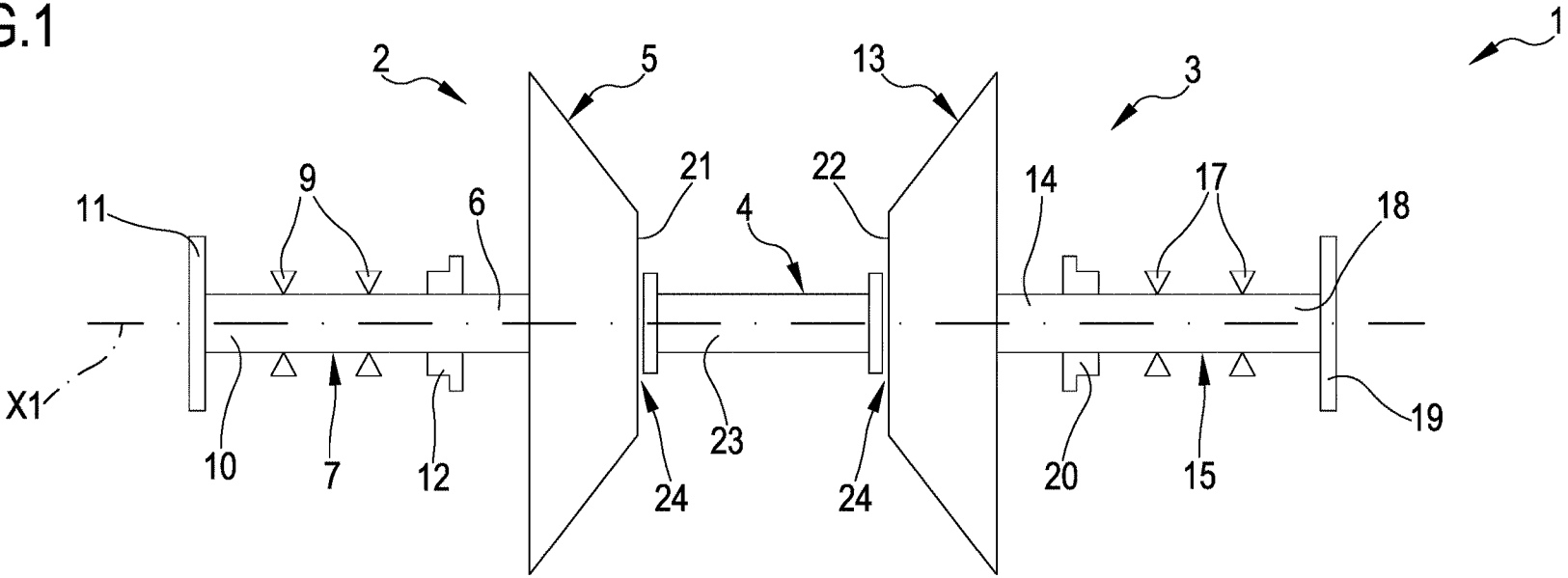
FIG. 1 schematically illustrates a set of turbines according to the present invention.

With reference to the figures cited, a set of turbines in accordance with the present invention is indicated in its entirety by the reference number 1. The set 1 comprises a first turbine 2 and a second turbine 3, each one being of the overhung type and they are connected to each other by a connection element 4.

As shown schematically in FIGS. 1, 2, 3 and 4, the first turbine 2 comprises a first rotor 5 joined to a distal end 6 of a first shaft 7. The first shaft 7 is supported in a first case 8 (not visible in the schematic FIGS. 1, 2, 3 and 4, but represented in detail in FIGS. 6-10) by two first support elements 9 (bearings) that are radially interposed between the first shaft 7 and the first case 8 and configured to enable free rotation of said first shaft 7 together with the first rotor 5, with respect to the first case 8, about a first main axis "X1". A proximal end 10 of the first rotor 7 is provided with a connection flange 11 for the transmission of power. The connection flange 11 defines or is part of a connection device configured to enable joining, for example, to another set of turbines 1 or to another turbine of a known type or to a generator. A mechanical seal 12 surrounds the first shaft 7 in proximity to the first rotor 5.

Likewise, the second turbine 3 comprises a second rotor 13 joined to a distal end 14 of a second shaft 15. The second shaft 15 is supported in a second case 16 (not visible in the schematic FIGS. 1, 2, 3 and 4, but represented in detail in FIGS. 6-10) by two second support elements 17 (bearings) that are radially interposed between the second shaft 15 and the second case 16 and configured to enable free rotation of said second shaft 15 together with the second rotor 13, with respect to the second case 16, about a second main axis "X2". A proximal end 18 of the second rotor 13 is provided with a connection flange 19 for the transmission of power. The connection flange 19 defines or is part of a connection device configured to enable joining, for example, to another set of turbines 1 or to another turbine of a known type or to a generator. A mechanical seal 20 surrounds the second shaft 15 in proximity to the second rotor 3.

The first and the second rotor 5, 13 are supported in an overhung manner with respect to the first and second support elements 9, 17 so that the respective first and second front face 21, 22 of the rotors 5, 13 remain free from support elements. Said first front face 21 and said second front face 22 face each other and the first and second shaft 7, 15 are substantially aligned, that is, the first and the second main axis "X1", "X2" substantially coincide. The connection element 4 connects the first front face 21 to the second front face 22 and, in the illustrated embodiments, it comprises a drive shaft 23. A third main axis "X3" of the drive shaft 23 is substantially aligned with the first shaft 7 and the second shaft 15. The opposite ends of the drive shaft 23 are connected to the centres of the first rotor 5 and the second rotor 13 by means of respective elastic joints 24.

Each elastic joint 24 may also be known in itself.

Figure 5:
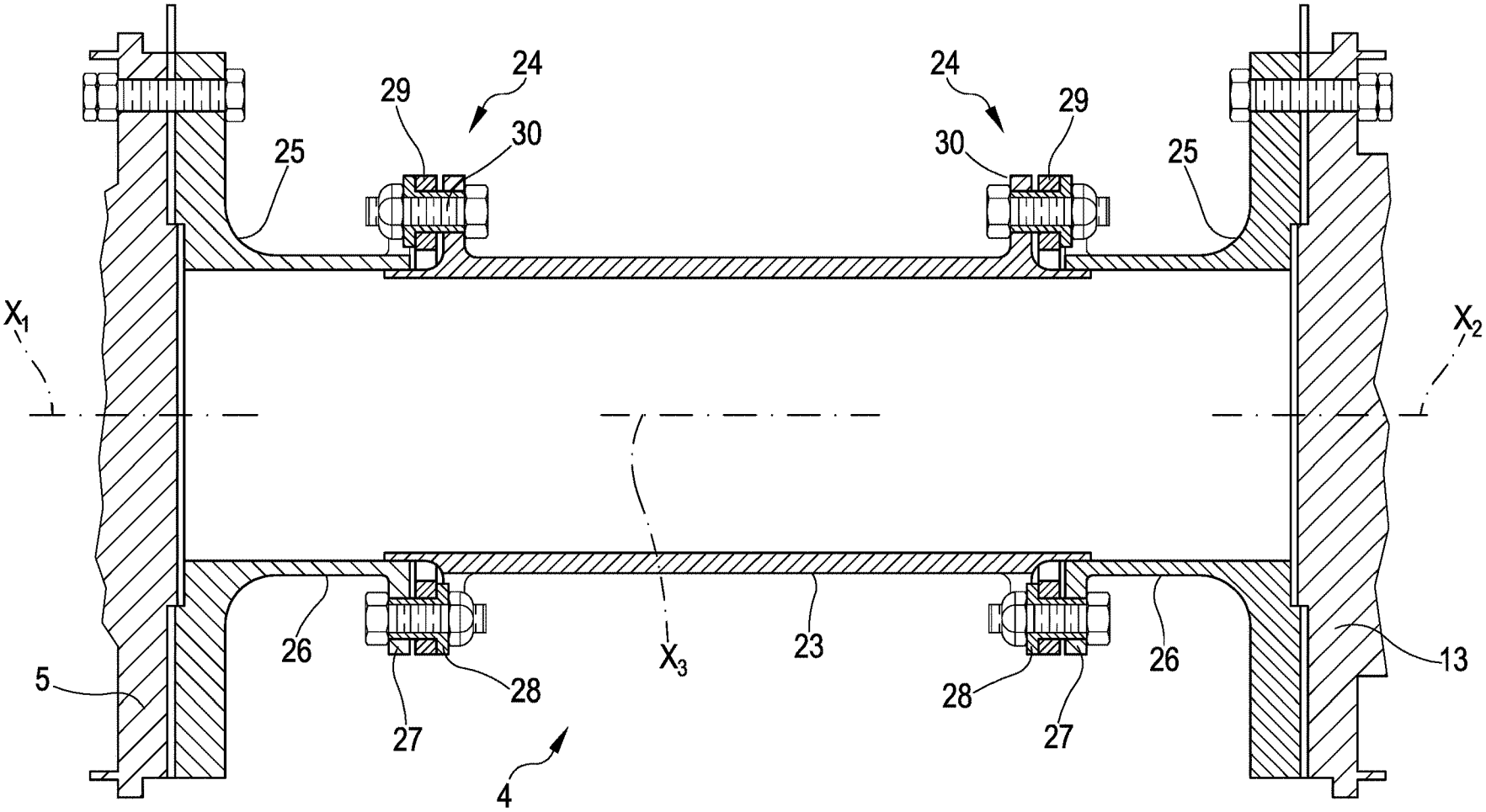
FIG. 5 illustrates an example of a connection element between the turbines making up the set according to the invention.
Figure 6:
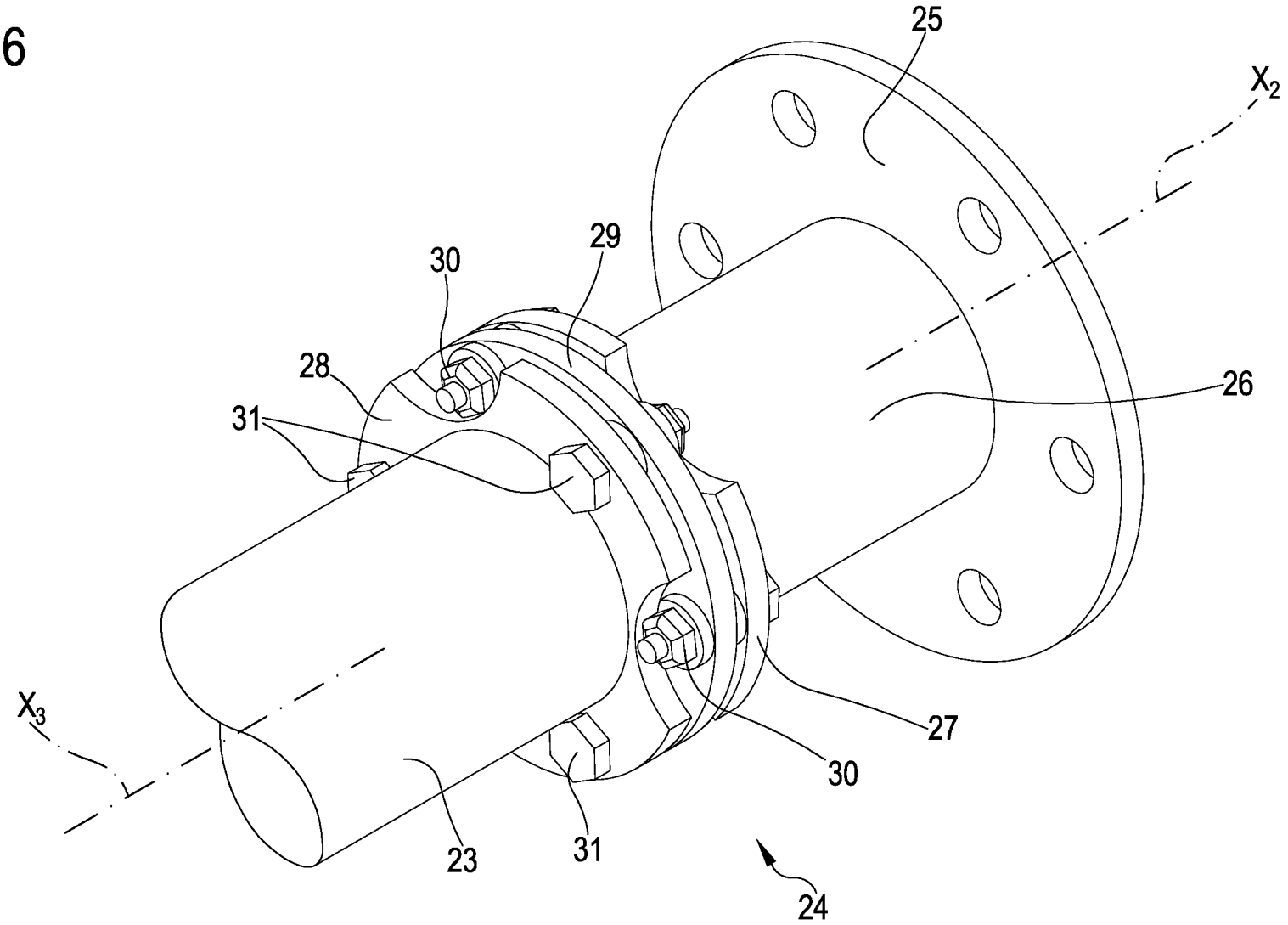
FIG. 6 illustrates an example of an elastic joint that is part of the connection element of FIG. 5.

In the embodiment illustrated in FIGS. 5 and 6, the elastic joint 24 is of the type having a flexible disc or discs. The illustrated elastic joint 24 comprises a flange 25 that is connected rigidly, for example by means of bolts, to the respective first or second rotor 5, 13. The flange 25 bears a tubular body 26 terminating with a first annular edge 27. A second annular edge 28 is rigidly connected to or is part of each end of the drive shaft 23. One or more flexible discs 29 substantially annular in shape are located between the first annular edge 27 and the second annular edge 28. The surface of the flexible discs 27 is substantially perpendicular to the main axes "X1", "X2" and to the axis of the drive shaft 23. The first annular edge 27 is connected to the flexible disc(s) 29 by means of first bolts and the second annular edge 28 is connected to the same flexible discs 29 by means of second bolts 31. The first bolts 30 are circumferentially alternated with the second bolts 31.

The flexible discs 29 of each one of the two elastic joints 24 permit limited relative movements between the drive shaft 23 and the respective flange 25. For example, these relative movements consist of the following: translational movement along three axes that are perpendicular to each other and/or rotation about a plurality of axes differing from the first, the second and third main axis "X1", "X2", "X3". The rotation about the first and/or the second and/or the third main axis "X1", "X2", "X3" (torsion) is instead preferably prevented so as to enable proper transmission of the torque.

In other words, with respect to a plane in which the flexible discs lie in their flat and undeformed configuration, said discs bend/deform outside of said plane.

Therefore, the elastic joint is yielding and elastic in flexure and traction/compression, but not in torsion. The flexure is such as to permit an inclination, for example of 0.2°, of the rigid parts, which said joint connects. This traction/compression is such as to enable the rigid parts, which said joint connects, to move about +/−5 mm away/towards each other.

The set of turbines 1 can be used alone connected to one or two generators 32 by means of the connection flange 11 of the first shaft 7 and/or the connection flange 19 of the second shaft 15.

Figure 2:
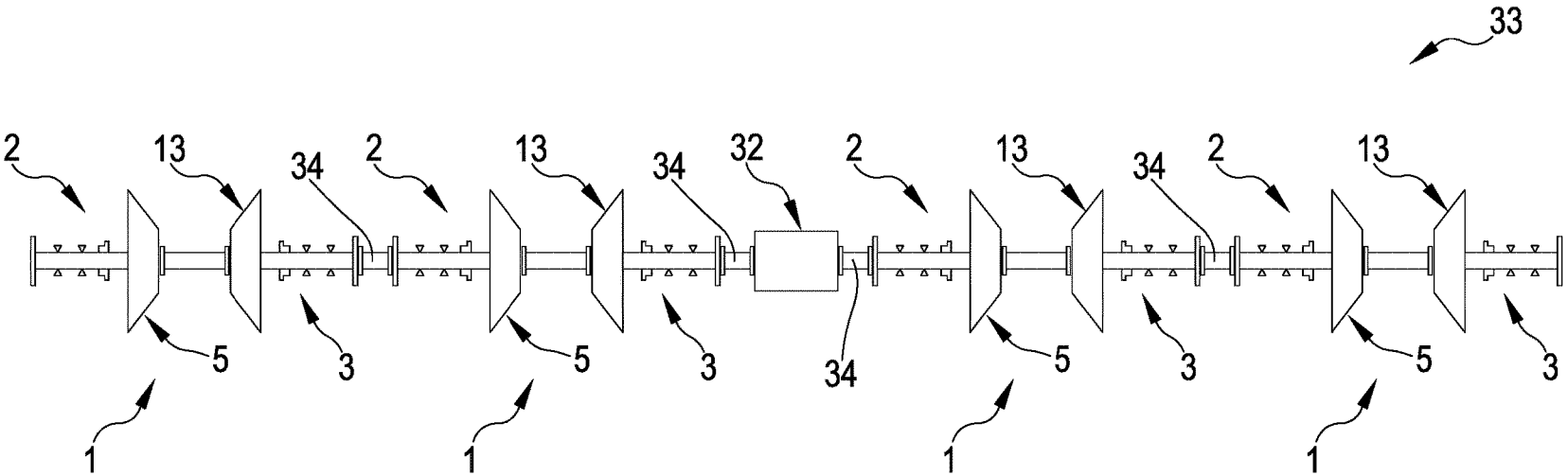
FIG. 2 schematically illustrates a turbine train comprising a number of sets according to the present invention.

FIG. 2 illustrates a turbine train 33 comprising a plurality of sets 1 of the type described above, each of which thus constituting one module of the train 33. In the illustrated embodiment, the turbine train 33 comprises a first pair of sets 1 and a second pair of sets 1. Each set 1 of each pair is connected to the other set 1 by means of an auxiliary connection element 34 interposed between the connection flanges 11, 19. This auxiliary connection element 34 may be similar or identical to the connection element 4 described hereinabove or it may be a rigid joint. The two pairs are connected to opposite shafts of a single generator 32 by means of auxiliary connection elements 34.

Figure 3:
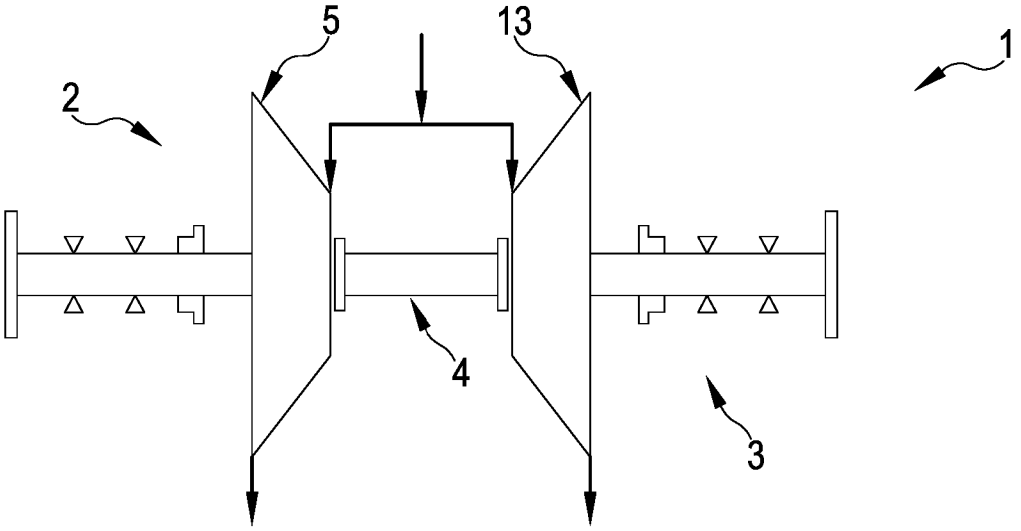
FIG. 3 illustrates the set appearing in FIG. 1 with a first type of fluid coupling between the turbines.
Figure 4:
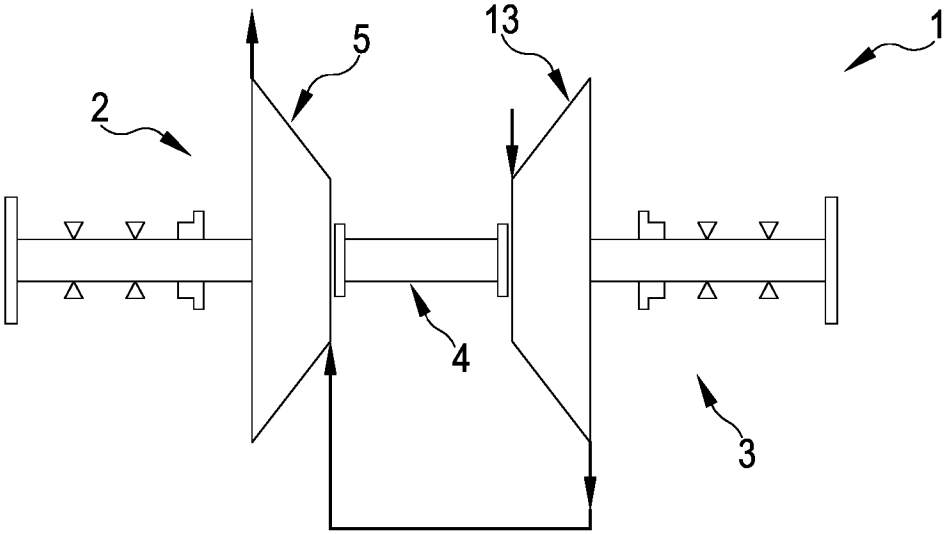
FIG. 4 illustrates the set appearing in FIG. 1 with a different type of fluid coupling between the turbines.

FIGS. 3 and 4 illustrate two types of fluidic connection between the first and the second turbine 2, 3 of a set 1. In FIG. 3, the first and the second turbine 2, 3 are connected in parallel. The working fluid enters through a common inlet and it is subdivided into two streams, each one entering in one of the turbines 2, 3. In FIG. 4, the first and the second turbine 2, 3 are connected in series. The working fluid passes first through the second turbine 3, exits from the second turbine and then passes through the first turbine 2.

Figure 7:
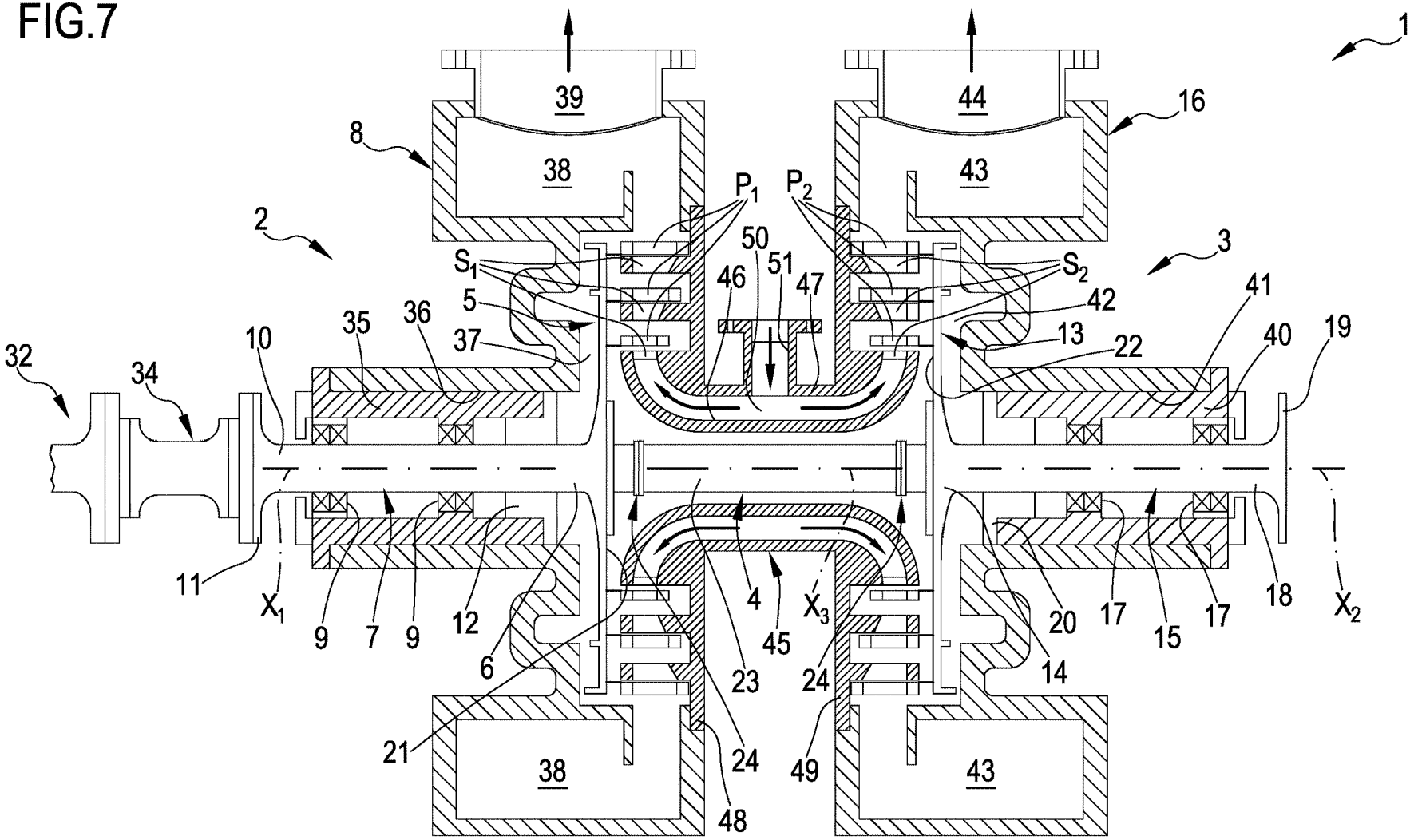
FIG. 7 illustrates a first embodiment of the set appearing in FIG. 1.

A first embodiment of the set 1 is illustrated in greater detail in FIG. 7.

FIG. 7 shows the first case 8 of the first turbine 2 in which the first shaft 7 and the first rotor 5 are housed. In particular, the first shaft 7 is inserted and rotatably supported by means of the first support elements 9 in a first sleeve 35. The mechanical seal 12 of the first shaft 7 is located at one end of the first sleeve 35, said end facing the first rotor 5, and it is radially interposed between said first sleeve 35 and said first shaft 7.

The first sleeve 35 is inserted in a seat 36 afforded in the first case 8 and it is fixed to the first case 8. The distal end 6 of the first shaft 7 projects out from the first sleeve 35 and from the mechanical seal 12 and projects inside the first case 8.

The proximal end 10 of the first shaft 7 and the connection flange 11 project out from the first sleeve 35 and also from the first case 8. The first sleeve 35 is extractable from the respective seat 36 on the opposite side with respect to the first rotor 5 and together with the support elements 9 and the first shaft 7 (after having disconnected it from the first rotor 5).

The first case 8 delimits a first housing space 37 for the first rotor 5 and a first annular discharge space 38 that surrounds the first housing space 37. A first discharge opening 39 connects the first annular discharge space 38 with the exterior or with a suitable circuit.

The first turbine 2 is of a centrifugal radial (outflow) type. The first rotor 5 comprises concentric annular arrays of first rotor blades "P1" arranged on the first front face 21 at a first transit and expansion space for the working fluid.

Each of the first rotor blades "P1" extends away from the first front face 21 with the leading edge and trailing edge thereof substantially parallel to the first main axis "X1".

FIG. 7 shows the second case 16 of the second turbine 3 in which the second shaft 15 and the second rotor 13 are housed. The second shaft 15 is inserted and rotatably supported by means of the second support elements 17 in a second sleeve 40. The mechanical seal 20 of the second shaft 15 is located at one end of the second sleeve 40, said end facing the second rotor 13, and it is radially interposed between said second sleeve 40 and said second shaft 15.

The second sleeve 40 is inserted in a seat 41 afforded in the second case 16 and it is fixed to the second case 16. The distal end 14 of the second shaft 15 projects out from the second sleeve 41 and from the mechanical seal 20 and projects inside the second case 16. The proximal end 18 of the second shaft 15 and the connection flange 19 project out from the second sleeve 40 and also from the second case 16. The second sleeve 40 is extractable from the respective seat 41 on the opposite side with respect to the second rotor 13 and together with the support elements 17 and the second shaft 15 (after having disconnected it from the second rotor 13).

The second case 16 delimits a second housing space 42 for the second rotor 13 and a second annular discharge space 43 that surrounds the second housing space 42. A second discharge opening 44 connects the second annular discharge space 43 with the exterior or with a suitable circuit.

The second turbine 3 is also of the centrifugal radial (outflow) type. The second rotor 13 comprises concentric annular arrays of second rotor blades "P2" arranged on the second front face 22 at a second transit and expansion space for the working fluid.

Each of the second rotor blades "P2" extends away from the second front face 22 with the leading edge and trailing edge thereof substantially parallel to the second main axis "X2".

A casing 45 is interposed between the first case 8 and the second case 16 and connects them so as to form, together with said first and second case 8, 16, a single box-like containment body.

The casing 45 appearing in FIG. 7 comprises a radially internal tubular body 46 that surrounds the drive shaft 23 and a radially external tubular body 47 arranged coaxially around the radially internal tubular body 46.

The casing 45 further comprises a first wall 48 that extends radially around a first end of the radially external tubular body 47 and that is connected to the first case 8 and closes a front opening of said first case 8, and a second wall 49 that extends radially around a second end of the radially external tubular body 46 and that is connected to the second case 16 and closes a front opening of said second case 16.

One face of the first wall 48 inside the first case 8 bears concentric annular arrays of first stator blades "S1" that are radially alternated with the annular sets of first rotor blades "P1". Likewise, one face of the second wall 49 inside the second case 16 bears concentric annular arrays of second stator blades "S2" that are radially alternated with the annular arrays of second rotor blades "P2".

The radially innermost annular array of first stator blades "S1" and the radially innermost annular array of second stator blades "S2" connect the radially internal tubular body 46 to the radially external tubular body 47. The radially external tubular body 47 thus supports the radially internal tubular body 46 by means of said radially innermost annular arrays of first and second stator blades "S1", "S2".

The radially internal tubular body 46 and the radially external tubular body 47 delimit together a conduit 50 having a substantially cylindrical shape with the opposite ends thereof terminating at the radially innermost annular arrays of first and second stator blades "S1", "S2".

An inlet mouth 51 is defined on the radially external tubular body 47 and it extends perpendicular to a central axis of said radially external tubular body 47 and permits the working fluid to enter the conduit 50. The inlet mouth 51 is located in an axially middle area of the radially external tubular body 47 so that the incoming fluid divides into two streams: a first stream directed towards the radially innermost first stator blades "S1" and a second stream directed towards the radially innermost second stator blades "S2". The first stream passes radially through the first rotor 5 of the first turbine 2, as it expands, thereby determining the rotation thereof; it then enters into the first annular discharge space 38 and flows out from first turbine 2 through the first discharge opening 39. The second stream passes radially through the second rotor 13 of the second turbine 3, as it expands, thereby determining the rotation thereof; it then enters into the second annular discharge space 43 and flows out from the second turbine 3 through the second discharge opening 44. The conduit 50 is therefore an inlet conduit for the working fluid in both turbines 2, 3 of the set 1. As concerns the flow of fluid, the first and the second turbine 2, 3 are connected in parallel.

Figure 8:
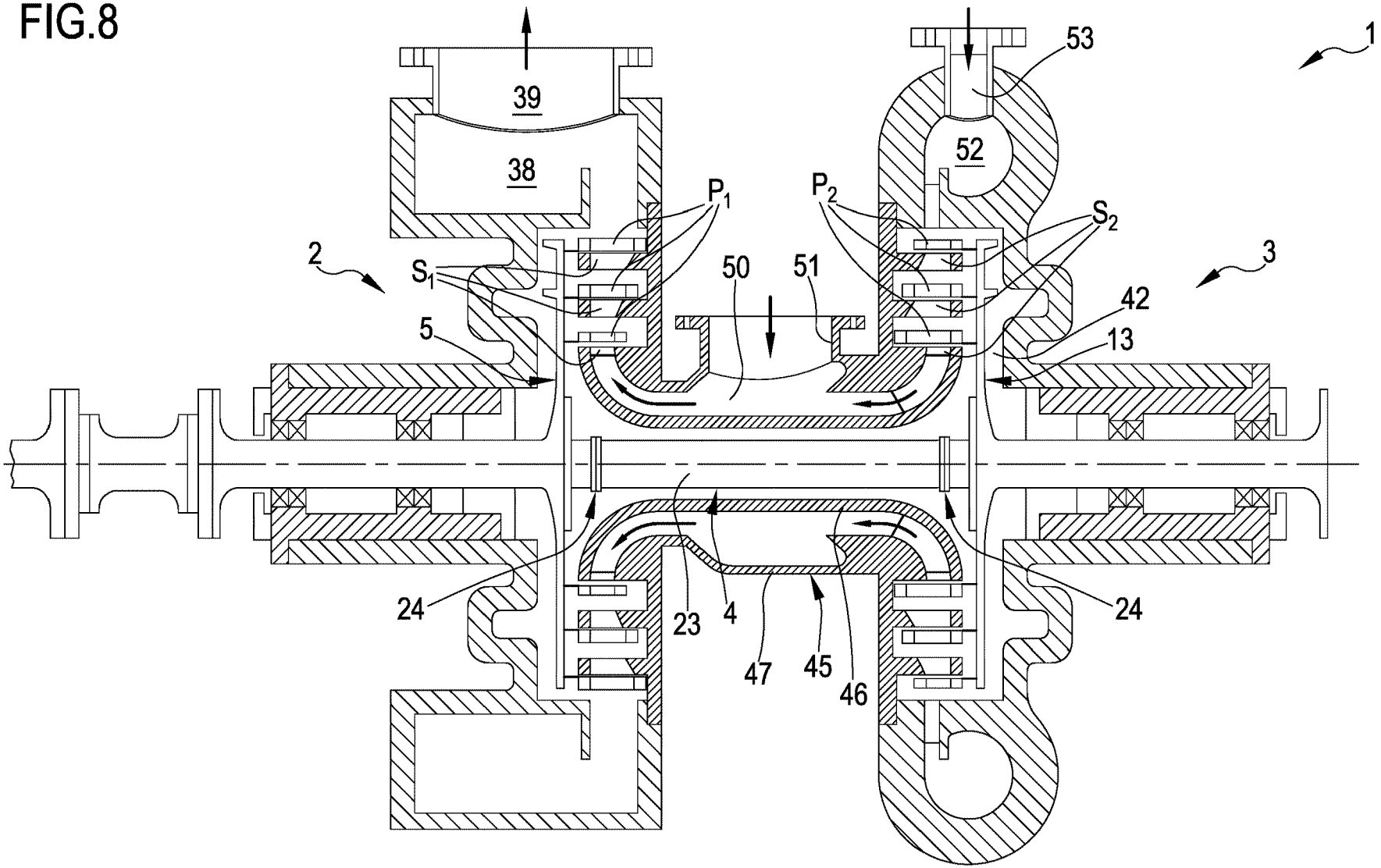
FIG. 8 illustrates a second embodiment of the set appearing in FIG. 1.

A second embodiment of the set 1 is illustrated in FIG. 8.

The first turbine 2 of the set 1 appearing in FIG. 8 is identical to the first turbine 2 of the first embodiment described previously (the reference numbers are the same) and therefore it is not be described in further detail herein below.

The second turbine 3 of the set 1 appearing in FIG. 8 differs from the second turbine 3 in the first embodiment described previously in that it is a radial centripetal (inflow) turbine. The second case 16 delimits an annular inlet space 52 that surrounds the second housing space 42. An inlet opening 53 connects the annular inlet space 52 with a suitable circuit. The working fluid enters into the second turbine 3 through the inlet opening 53 and flows into the annular inlet space 52. Moving radially towards the first main axis "X1", and expanding, the working fluid thus passes through the second rotor 13 of the second turbine 3, thereby determining the rotation thereof, and then flows into the conduit 50 through the radially innermost second stator blades "S2" towards the radially innermost first stator blades "S1" of the first turbine 2.

In this second embodiment, the inlet mouth 51 constitutes an intermediate admission mouth through which an additional stream of working fluid is admitted.

This additional stream enters into the conduit 50 and, dragged by the working fluid coming from the second turbine 3 and directed by the internal shape of the inlet mouth 51, it too flows towards the radially innermost first stator blades "S1" of the first turbine 2. The working fluid, the sum total of the fluid coming from the second turbine 3 and the fluid coming from the intermediate admission mouth 51, passes through the first rotor 5 of the first turbine 2, as it expands, thereby determining the rotation thereof; it then enters into the first annular discharge space 38 and flows out from the first turbine 2 through the first discharge opening 39. The conduit 50 is thus an inlet conduit for admitting the working fluid into the first rotor 5 and an outlet conduit for letting it flow out from the second rotor 13. It should be noted that the remaining elements of the set 1 in this second embodiment are the same as those in the first embodiment appearing in FIG. 7 and they have the same reference numbers. As concerns the flow of fluid, the first and the second turbine 2, 3 are connected in series.

Figure 9:
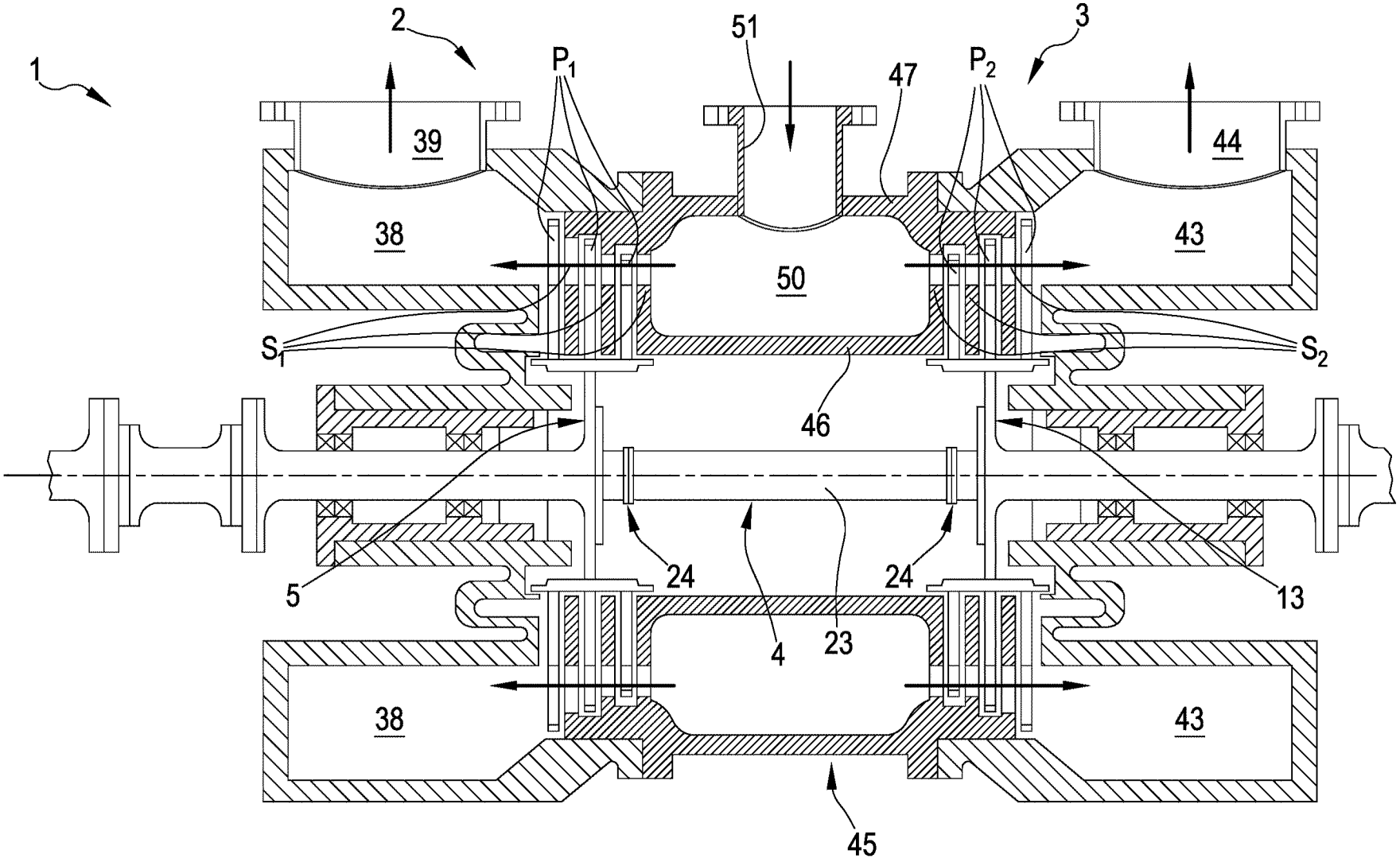
FIG. 9 illustrates a third embodiment of the set appearing in FIG. 1.

A third embodiment of the set 1 is illustrated in FIG. 9. In this case as well, the elements of the set 1 that are identical to those of the preceding embodiments have the same reference numbers.

The third embodiment differs from the preceding embodiments in that both turbines 2, 3 are of the axial type.

The first rotor 5 comprises circumferential arrays of first rotor blades "P1" arranged at a radially peripheral portion of the first rotor 5 and at a first transit and expansion space for the working fluid. The first rotor blades "P1" extend in a radial pattern away from the first main axis "X1" with the leading edge and trailing edge thereof substantially perpendicular to the first main axis "X1".

The second rotor 13 comprises circumferential arrays of second rotor blades "P2" arranged at a radially peripheral portion of the second rotor 5 and at a second transit and expansion space for the working fluid. The second rotor blades "P2" extend in a radial pattern away from the second main axis "X2" with the leading edge and trailing edge thereof substantially perpendicular to the second main axis "X2."

The casing 45 comprises the radially internal tubular body 46 and the radially external tubular body 47 with the inlet mouth 51 and they delimit the conduit 50, but it does not have the first and the second wall that extend radially.

Unlike the first and the second embodiments, circumferential arrays of first stator blades "S1" are afforded on a radially internal surface of the radially external tubular body 47. Said first stator blades "S1" radially extend towards the first rotor 5, that is, towards the first main axis "X1", and they are radially alternated with the circumferential arrays of first rotor blades "P1". The circumferential array of first stator blades "S1" bordering on the conduit 50 is connected to and supports the radially internal tubular body 46. Likewise, circumferential arrays of second stator blades "S2" are afforded on a radially internal surface of the radially external tubular body 47. Said second stator blades "S2" radially extend towards the second rotor 13, that is, towards the second main axis "X2", and they are radially alternated with the circumferential arrays of second rotor blades "P2". The circumferential array of second stator blades "S2" bordering on the conduit 50 is connected to and supports the radially internal tubular body 46.

The fluid entering through the inlet mouth 51 is divided into two streams: a first stream directed towards the first stator blades "S1" and first rotor blades "P1" and a second stream directed towards the second stator blades "S2" and second rotor blades "P2". The first stream passes axially through the first rotor 5 of the first turbine 2, as it expands, thereby determining the rotation thereof; it then enters into the first annular discharge space 38 and flows out from first turbine 2 through the first discharge opening 39. The second stream passes axially through the second rotor 13 of the second turbine 3, as it expands, thereby determining the rotation thereof; it then enters into the second annular discharge space 43 and flows out from the second turbine 3 through the second discharge opening 44. As concerns the flow of fluid, the first and the second turbine 2, 3 are connected in parallel.

Figure 10:
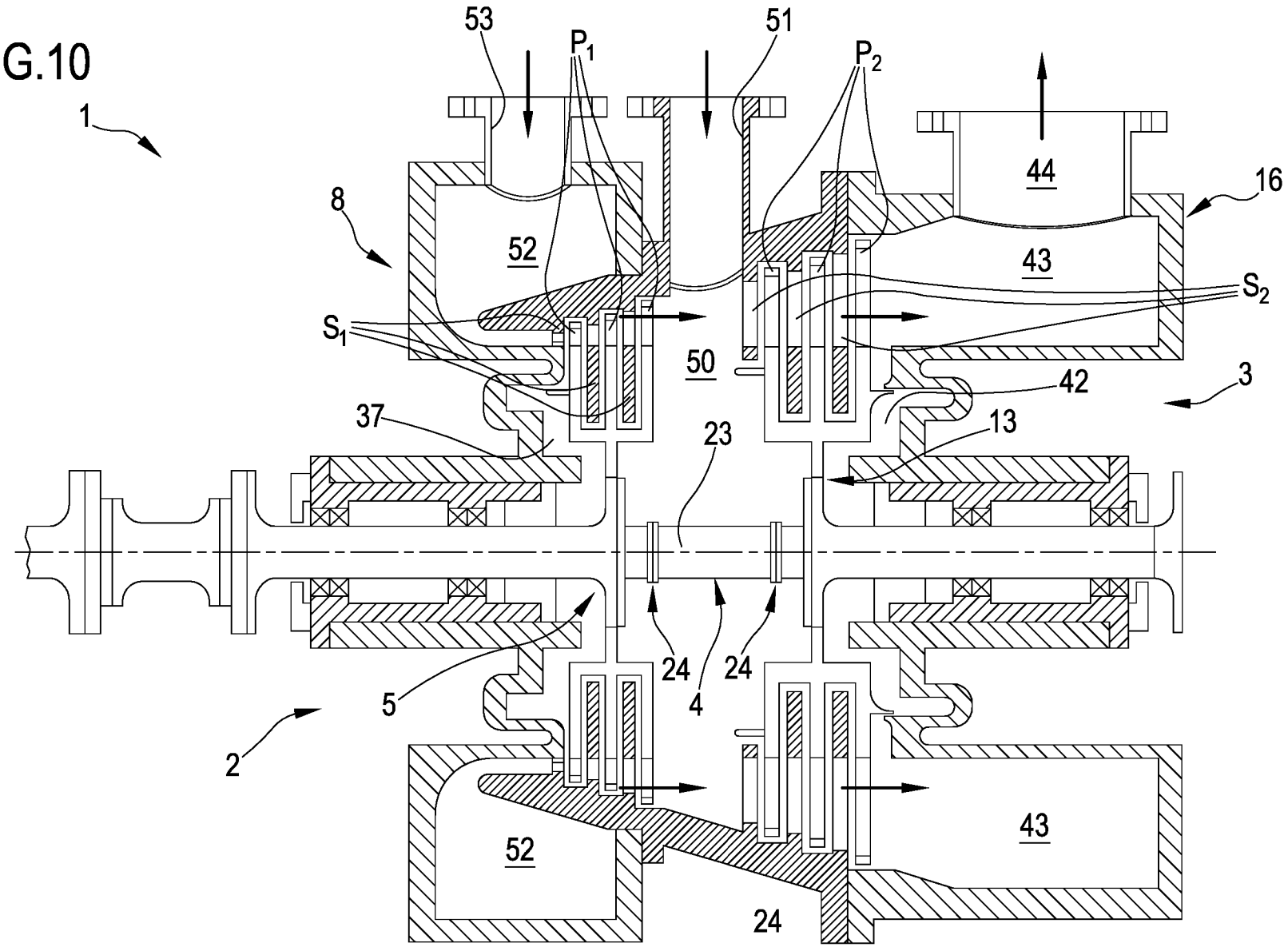
FIG. 10 illustrates a fourth embodiment of the set appearing in FIG. 1.

A fourth embodiment of the set 1 is illustrated in FIG. 10. In this case as well, the elements of the set 1 that are identical to those of the preceding embodiments have the same reference numbers.

This fourth embodiment of the set 1 differs from the third embodiment appearing in FIG. 9 in that the working fluid passes through first turbine 2 and the second turbine 3 (again of the axial type) in series. Furthermore, the radially internal tubular body 46 is not present and the conduit 50 is delimited by the radially external tubular body 47 alone.

The first case 8 delimits an annular inlet space 52 that partly surrounds the first housing space 37. An inlet opening 53 connects the annular inlet space 52 with a suitable circuit.

The working fluid enters into the first turbine 2 through the inlet opening 53 and flows into the annular inlet space 52. Moving axially and expanding, the working fluid passes through the first rotor and stator blades "P1", "S1" of the first rotor, thereby determining the rotation thereof; it then flows into the conduit 50 and subsequently, moving axially and expanding, it passes through the second rotor and stator blades "P2", "S2" of the second rotor 13, thereby determining the rotation thereof. In this fourth embodiment as well, the inlet mouth 51 constitutes an intermediate admission mouth through which an additional stream of working fluid is admitted. This additional stream enters into the conduit 50 and, dragged by the working fluid coming from the first turbine 2, it too flows towards the second turbine 3. The working fluid, the sum total of the fluid coming from the first turbine 2 and the fluid coming from the intermediate admission mouth 51, passes axially through the second rotor 13 of the second turbine 3, as it expands, thereby determining the rotation thereof; it then enters into the second annular discharge space 43 and flows out from the second turbine 3 through the second discharge opening 44.

Figure 11:
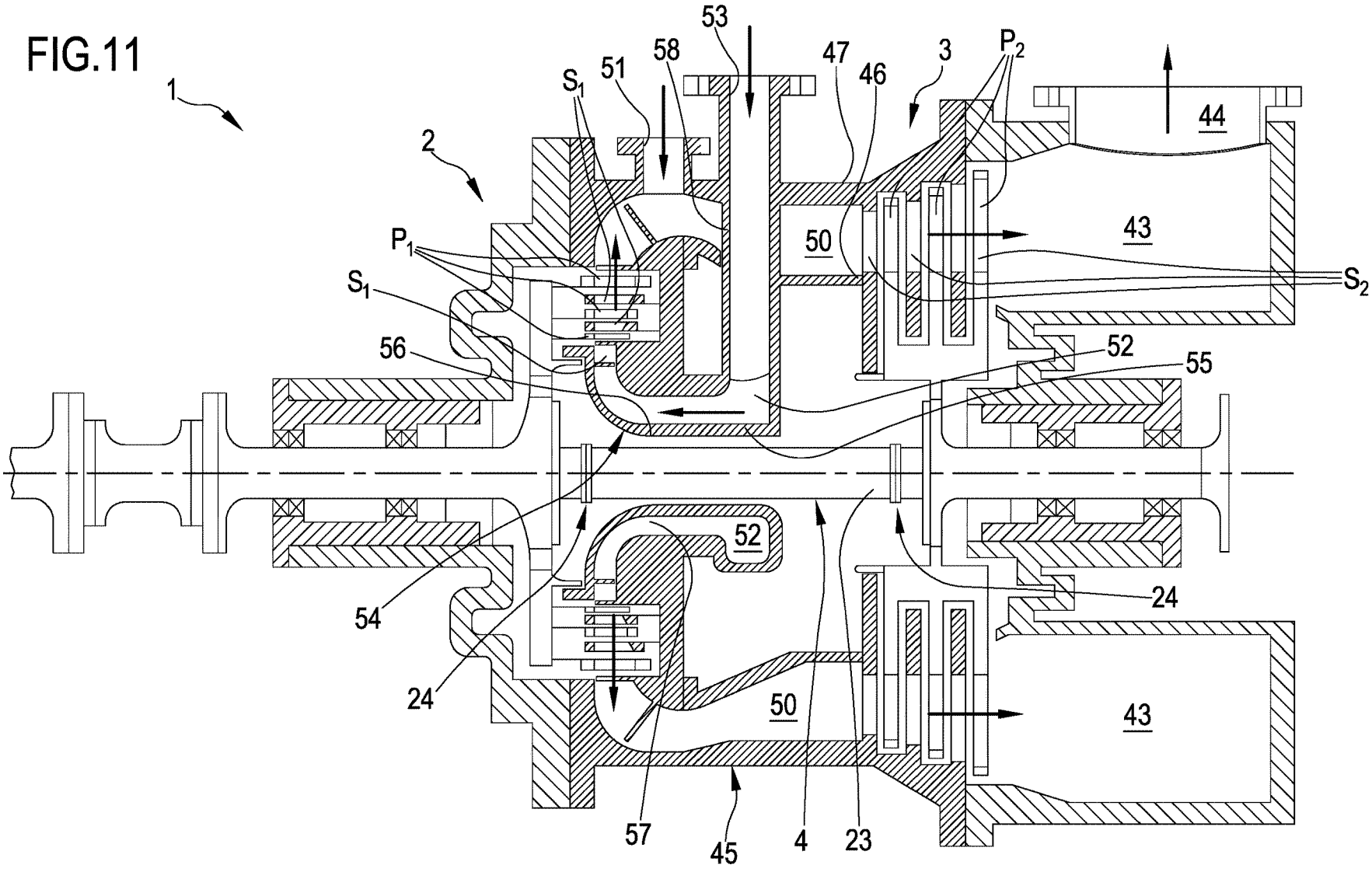
FIG. 11 illustrates a fifth embodiment of the set appearing in FIG. 1.

A fifth embodiment of the set 1 is illustrated in FIG. 11. In this case as well, the elements of the set 1 that are identical to those of the preceding embodiments have the same reference numbers.

This fifth embodiment of the set 1 differs from the preceding embodiments in that the first turbine 2 is of the centrifugal radial type, whereas the second turbine 3 is of the axial type. The first turbine 2 is similar to the first turbine 3 of the first and the second embodiment (centrifugal radial, FIGS. 7 and 8), but it does not have the first annular discharge space 38 or the first discharge opening 39. The second turbine 3 is substantially identical to the second turbine 3 of the third embodiment described hereinabove (FIG. 9).

The casing 45 comprises the radially internal tubular body 46 and the radially external tubular body 47 with the inlet mouth 51 and they delimit the conduit 50.

The conduit 50 is connected to the second turbine 3 in the same manner as in the third embodiment (FIG. 9). The conduit 50 is connected to the first turbine 3 at the radially outermost annular array of first rotor blades "P1" of the first rotor 5.

The casing 45 further comprises an auxiliary portion 54 located around the connection element 4 in a radially internal position with respect to the radially internal tubular body 46. The auxiliary portion 54 comprises a radially internal tubular wall 55 and a radially external wall 56 that delimit an annular inlet space 52 and an auxiliary conduit 57. A pipe 58 is in fluid connection with the annular inlet space 52, passes through the radially internal tubular body 46 and the radially external tubular body 47, and exits from the set 1 through an inlet opening 53 configured to be connected to a suitable circuit.

The auxiliary conduit 57 extends from the annular inlet space 52 and terminates at the radially innermost annular array of first rotor blades "P1" of the first rotor 5. The radially internal annular array of first stator blades "S1" of the first turbine 2 is located and supported in this area by the casing 45. The casing 45 also supports the other arrays of first stator blades "S1."

Admitted through the inlet opening 53, the working fluid flows into the pipe 58 to the inside of the annular inlet space 52. The working fluid passes axially through the auxiliary conduit 57 and then it is deviated along radial directions and passes radially through the first rotor and stator blades "P1", "S1" of the first rotor 5 of the first turbine 2, as it expands, thereby determining the rotation thereof. Subsequently, the working fluid flows into the conduit 50 and then, moving axially and expanding, it passes through the second rotor and stator blades "P2", "S2" of the second rotor 13, thereby determining the rotation thereof.

In this fifth embodiment as well, the inlet mouth 51 constitutes an intermediate admission mouth through which an additional stream of working fluid is admitted. This additional stream enters into the conduit 50 and, dragged by the working fluid coming from the first turbine 2, it too flows towards the second turbine 3. The working fluid, the sum total of the fluid coming from the first turbine 2 and the fluid coming from the intermediate admission mouth 51, passes axially through the second rotor 13 of the second turbine 3, as it expands, thereby determining the rotation thereof; it then enters into the second annular discharge space 43 and flows out from the second turbine 3 through the second discharge opening 44.

In all of the embodiments described, the connection element 4 is contained in the casing 45 and it is immersed in the working fluid. The drive shaft 23 is coaxial with the radially external and/or internal tubular body 47, 46. The centre of both the first and the second rotor 5, 13 is free of the rotor blades and it is provided with the flange 25 of the respective elastic joint 24.

In other unillustrated embodiments, at least one of the turbines 2, 3 of the set 1 may be of the radial/axial type, that is, it may comprise at least one annular array of first/second rotor blades "P1", "P2" located on the respective front face 21, 22 (as in FIGS. 7, 8) and at least one circumferential array of first/second rotor blades "P1", "P2" arranged at a radially peripheral portion of the first/second rotor 5, 13 (as in FIGS. 9, 10). In other unillustrated embodiments, the casing 45 can be configured so as to have an outlet mouth for letting the working fluid flow out from the set 1 of turbines and/or an intermediate mouth for extracting the working fluid from the set 1 of turbines.

LIST OF ELEMENTS

1 set of turbines
2 first turbine
3 second turbine
4 connection element
5 first rotor
6 distal end of first shaft
7 first shaft
8 first case
9 first support elements
10 proximal end of first shaft
11 connection flange of first shaft
12 mechanical seal of first shaft
13 second rotor
14 distal end of second shaft
15 second shaft
16 second case
17 second support elements
18 proximal end of second shaft
19 connection flange of second shaft
20 mechanical seal of second shaft
21 first front face
22 second front face
23 drive shaft
24 elastic joints
25 flange
26 tubular body
27 first annular edge
28 second annular edge
29 flexible discs
30 first bolts
31 second bolts
32 generator
33 turbine train
34 auxiliary connection element
35 first sleeve
36 seat for the first case
37 first housing space
38 first annular discharge space
39 first discharge opening
40 second sleeve
41 seat for the second case
42 second housing space
43 second annular discharge space
44 second discharge opening
45 casing
46 radially internal tubular body
47 radially external tubular body
48 first wall
49 second wall
50 conduit
51 inlet mouth
52 annular inlet space
53 inlet opening
54 auxiliary portion
55 radially internal tubular wall
56 radially external tubular wall
57 auxiliary conduit
58 pipe
X1 first main axis X2 second main axis
X3 third main axis
P1 first rotor blades
P2 second rotor blades
S1 first stator blades
S2 second stator blades

The invention claimed is:

1. A set of turbines, comprising:

a first turbine comprising: a first case, a first shaft supported in the first case, first support elements radially interposed between the first shaft and the first case and configured to enable free rotation of the first shaft with respect to the first case about a first main axis, and a first rotor provided with first rotor blades and joined to a distal end of the first shaft, wherein the first rotor is supported in an overhung manner with respect to the first support elements, wherein the first rotor has a first front face facing the opposite side with respect to the first support elements;

a second turbine comprising: a second case, a second shaft supported in the second case, second support elements radially interposed between the second shaft and the second case and configured to enable free rotation of the second shaft with respect to the second case about a second main axis, and a second rotor provided with second rotor blades and joined to a distal end of the second shaft, wherein the second rotor is supported in an overhung manner with respect to the second support elements, wherein the second rotor has a second front face facing the opposite side with respect to the second support elements;

wherein the first front face faces the second front face and the first main axis is substantially aligned with the second main axis;

wherein the set of turbines further comprises a connection element connected to the first front face and to the second front face to transmit rotation from the first shaft to the second shaft or vice versa; and wherein the connection element comprises:

two elastic joints configured to minimize the rotordynamic influence of the first turbine and the second turbine on each other, at least one drive shaft that is substantially aligned with the first shaft and the second shaft, and wherein each elastic joint is located at one end of the drive shaft.

2. The set according to claim 1, wherein the two elastic joints are elastic in flexure.

3. The set according to claim 1, wherein the two elastic joints are elastic in traction/compression.

4. The set according to claim 1, comprising a casing connected to the first case and to the second case, wherein the connection element is contained in the casing.

5. The set according to claim 4, wherein the casing delimits at least one conduit for a working fluid passing through the first turbine and/or the second turbine.

6. The set according to claim 5, wherein the at least one conduit is an inlet/outlet conduit for admitting the working fluid into or for letting the working fluid flow out from the first and/or second turbine.

7. The set according to claim 4, wherein the casing delimits at least one conduit for a working fluid, and the at least one conduit sets the first rotor and the second rotor in fluid communication.

8. The set according to claim 4, wherein the casing comprises at least one tubular body that extends between the first case and the second case and is substantially coaxial with the connection element.

9. The set according to claim 8, wherein the casing delimits at least one conduit for a working fluid, and the casing comprises a radially internal tubular body and a radially external tubular body, wherein the at least one conduit is delimited between the radially internal tubular body and the radially external tubular body.

10. The set according to claim 9, wherein the radially internal tubular body surrounds the connection element.

11. The set according to claim 4, wherein the casing has an inlet mouth for admitting a working fluid into the set of turbines.

12. The set according to claim 11, wherein the inlet mouth is an intermediate mouth for admitting the working fluid into the set of turbines.

13. The set according to claim 1, wherein the first turbine and/or the second turbine are of the type selected from the group consisting of: radial turbines, axial turbines, and radial/axial turbines.

14. A set of turbines, comprising:

a first turbine comprising: a first case, a first shaft supported in the first case, first support elements radially interposed between the first shaft and the first case and configured to enable free rotation of the first shaft with respect to the first case about a first main axis, and a first rotor provided with first rotor blades and joined to a distal end of the first shaft, wherein the first rotor is supported in an overhung manner with respect to the first support elements, wherein the first rotor has a first front face facing the opposite side with respect to the first support elements;

a second turbine comprising: a second case, a second shaft supported in the second case, second support elements radially interposed between the second shaft and the second case and configured to enable free rotation of the second shaft with respect to the second case about a second main axis, and a second rotor provided with second rotor blades and joined to a distal end of the second shaft, wherein the second rotor is supported in an overhung manner with respect to the second support elements, wherein the second rotor has a second front face facing the opposite side with respect to the second support elements; and a casing connected to the first case and to the second case;

wherein the first front face faces the second front face and the first main axis is substantially aligned with the second main axis;

wherein the set of turbines further comprises a connection element connected to the first front face and to the second front face to transmit rotation from the first shaft to the second shaft or vice versa;

wherein the connection element comprises at least one elastic joint configured to minimize the rotordynamic influence of the first turbine and the second turbine on each other, wherein the connection element is contained in the casing, wherein the casing comprises a radially internal tubular body and a radially external tubular body that extend between the first case and the second case, and are substantially coaxial with the connection element, and wherein the casing delimits at least one conduit for a working fluid, and the at least one conduit is delimited between the radially internal tubular body and the radially external tubular body.

15. The set according to claim 14, wherein the radially internal tubular body surrounds the connection element.

* * * * *